United States Patent [19]

Umlauft et al.

[11] Patent Number: 4,776,592

[45] Date of Patent: Oct. 11, 1988

[54] DEVICE FOR THE PROTECTION OF THE STRINGS OF A BALL RACKET, PARTICULARLY TENNIS RACKET

[75] Inventors: Helmut Umlauft, Hard; Karl-Heinz Wäger, Götzis, both of Austria

[73] Assignee: Head Sportgeräte Gesellschaft m.b.H. & Co.OHG., Wuhrkopfweg, Austria

[21] Appl. No.: 883,787

[22] Filed: Jul. 9, 1986

[30] Foreign Application Priority Data

Jul. 9, 1985 [AT] Austria ..... 2031/85

[51] Int. Cl.[4] ..... A63B 51/10

[52] U.S. Cl. ..... 273/73 D; 273/73 C

[58] Field of Search ..... 273/73 R, 73 D, 73 C, 273/73 H, 73 K; 24/140

[56] References Cited

U.S. PATENT DOCUMENTS 3,642,283 2/1972 Wilkens ..... 273/73 G

FOREIGN PATENT DOCUMENTS 446157 3/1949 Italy ..... 24/140

*Primary Examiner*—Leo P. Picard
*Assistant Examiner*—William E. Stoll
*Attorney, Agent, or Firm*—Millen & White

[57] ABSTRACT

A device for the protection of strings on the frame of a racket, such as for example, a tennis racket, comprises a band-like body which includes a plurality of tubular sleeves spaced a distance corresponding to the distance of bores in the frame of the racket. The band-like body further includes a peripheral groove which groove is in open connection with the tubular sleeves. The strings are placed into the peripheral groove and are strung through the tubular sleeves. The band-like body has protruding wall parts located on the side of the groove facing the tubular sleeves, which wall parts are connected with lateral parts of the body that overlap the frame. The protruding wall parts close the peripheral groove so that the strings lie protected within the peripheral groove.

10 Claims, 4 Drawing Sheets

DEVICE FOR THE PROTECTION OF THE STRINGS OF A BALL RACKET, PARTICULARLY TENNIS RACKET

BACKGROUND OF THE INVENTION

1. Field of the Invention

The invention relates to a device for the protection of the strings of a ball racket, particularly tennis racket, with a bandlike body, which is positionable in a peripheral groove at the outside of the frame, for tubular sleeves, which engage with radial openings in the peripheral groove of the frame, wherein the body comprises an external peripheral groove.

2. Prior Art

For the mounting of strings for stringing a tennis racket is is known to insert eyelets into radial openings arranged at predetermined intervals on the frame, through which the strings are run during stringing and hereafter are put under tensile stress with an appropriate stringing device. The eyelets serve to fix the position and reduce the stress on the strings being laced through the periphery of the frame of the tennis racket.

With these known constructions there exists the disadvantageous fact that the parts of the strings running along the periphery of the frame of the tennis racket lie exposed, and it has been already proposed to provide a groove extending in peripheral direction at the outside of the frame of the tennis racket to guarantee some protection of the string in this area. Within this peripheral groove the strings remain nevertheless exposed so that on the one hand there results a sight disturbing the general view of the racket and on the other hand there exists the danger that by touching the outer edge of the racket with pointed objects there may take place an unintended shifting of parts of the strings in this groove and thereby an unintended change of the tensile stress of the strings as well as some damaging of the strings.

From the DE-OS No. 20 10 450 a tennis racket of a light metal alloy has become known, with which the strings being positioned in a peripheral groove of the frame can be covered by an insertable strip of ductile material. U.S. Pat. No. 4,280,699 shows a racket with a metal frame with a stepped U-shaped cross-section, into which a T-shaped body of resistive synthetic material is bonded, wherein the body comprises a groove and openings for tensioning the strings and forms a flat surface with the frame. Furthermore from GB-PS No. 212 195 U-shaped metal sleeves for receiving the strings have become known with a metal racket, wherein the sleeves are put into openings of the frame. U.S. Pat. No. 4,220,335 shows and describes a racket with a body being arranged in a peripheral groove on the outside of the frame for tubular sleeves, which engage with openings in the peripheral groove of the frame, through which the strings are run for stringing. The body is formed according to the external contour of the frame and the string rests on the surface of the body after tensioning.

SUMMARY OF THE INVENTION

The invention aims at providing a device of the kind mentioned above, which allows to define more exactly the position of the strings at the external contour of a tennis racket and which offers the possibility of tensioning the strings while protected and covered. For solving this task the invention substantially provides the peripheral groove of the body with a covering formed by the protruding wall parts, which are moveable towards each other by tensioning the strings being put into the peripheral groove of the body. Because the peripheral groove is delimited by protruding wall parts, which are movable towards each other by tensioning the strings being put into the peripheral groove of the body, the peripheral groove of the body is closed at least partially so that the strings are lying completely protected in the peripheral groove. For facilitating the production and mounting of the racket the body consists of elasticly deformable material, particularly synthetic material.

According to a preferred embodiment of the invention the design is such that the side of the body facing the frame keeps free a space between the bottom of the peripheral groove of the frame and the body during the untensioned state of the strings, into which space the body is deformable by tensioning the strings.

As the body is formed of elastically deformable material the protruding parts of the body move towards each other after fastening the strings and close at least partially the peripheral groove, whereas a further improvement of the insertion of the body into the peripheral groove of the frame can be achieved by connecting the lateral parts of the body with the frame.

According to the invention as is shown the edges facing each other sit close one to another after mounting the strings and form recesses or openings in alignment with the tubular sleeves. The recesses or openings in alignment with the tubular sleeves make easier the mounting of the strings and subsequent stringing of the racket.

The arrangement can be made according to the invention that before mounting the strings the parts of the body overlapping the frame are inclined to the axis of the tubular sleeves with an angle different from the angle between the adjacent surfaces of the frame and the axis of the tubular sleeves. The angle which is enclosed between the parts of the body overlapping the frame before mounting the strings may be larger, for example. According to the invention the design is such that the protruding wall parts of the peripheral groove of the body close the peripheral groove after mounting the strings by deforming the angle of the parts of the body overlapping the frame. Therewith according to the invention in a cross-sectional profile the lateral parts of the body are formed according to the external contour of the frame.

In a preferred embodiment of the invention after mounting the strings at least the lateral edges of the lateral parts of the body fit closely with the frame of the tennis racket, through which an aerodynamically advantageous embodiment is produced. The tennis racket shows a lesser drag during hitting because of this aerodynamically advantageous embodiment and the hit can be performed with less effort. Because in this position the edges of the lateral parts fit closely with the frame of the racket and the providing wall parts touch each other, the peripheral groove is totally closed with the exception of the openings and the parts of the strings lying in the peripheral groove are therefore perfectly protected.

According to the invention the bottom of the peripheral groove of the body adjacent to the tubular sleeves comprises grooves with a rounded cross-section being adjacent to the protruding wall parts (12) and extending in longitudinal direction. That way the elastic deformation of the lateral parts of the body and also of the protruding wall parts is improved. According to the invention preferably the cross-section of the grooves is at least as large as the cross-section of the strings and between the grooves a bulge extending in longitudinal direction and arranged opposite the protruding wall parts is provided. Because of the bulge extending between the grooves the string is inevitably directed into one of the two grooves so that it takes up a precisely defined position in the peripheral groove. In several places it is necessary that two strings are arranged in the peripheral groove and two strings are run through the same tubular sleeve. In this case the second string is put into the groove which is still empty and is placed there also in a predetermined position. Thereby two strings are never placed on top of each other, which allows the tension to remain precise.

The strings are protected from damage and by reducing the drag during hitting a stronger hit is made possible.

BRIEF DESCRIPTION OF THE DRAWINGS

The invention is described in more detail in the following by means of an example being illustrated in the drawing.

DESCRIPTION OF THE PREFERRED EMBODIMENTS

Figure 1:
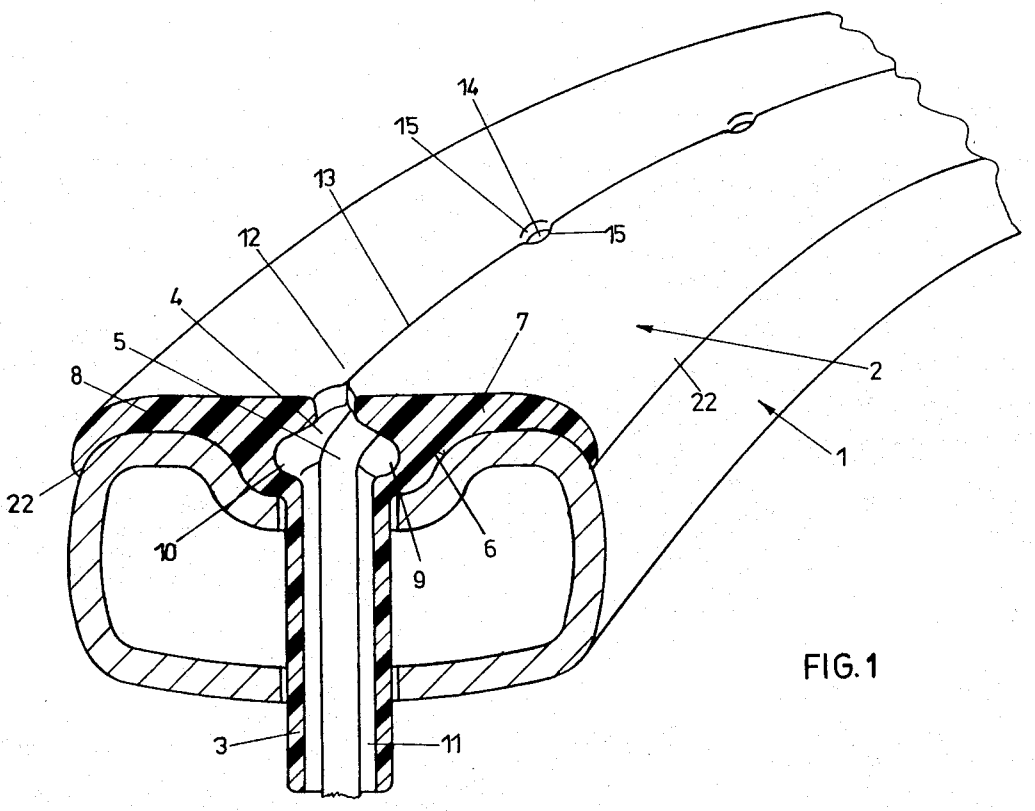
FIG. 1 shows a perspective view of a part of a frame of a tennis racket with inserted stringing, partly in sectional view, FIG. 2 a modified embodiment in a section of FIG. 1 without inserted strings and FIG. 3 the embodiment of FIG. 2 after fastening the strings, wherein for the sake of simplicity the strings are not shown.

In FIG. 1 there is shown a frame 1 of a tennis racket. A body 2 with a plurality of tubular sleeves 3 is provided for, in which body is arranged a peripheral groove 4 for receiving a string 5. In the representation of FIG. 1 the string 5 is already under tensile stress so that the body 2 is pressed to the external contour 6 of the frame 1. The contour of the lateral parts 7 and 8 of the body facing the frame 1 is formed according to the external contour 6 of the frame 1 so that a form-fitting overlapping results therefrom. The peripheral groove 4 comprises at its bottom two grooves 9 and 10, which favor the elastic deformation of the lateral parts 7 and 8. The string 5 is subsequently run through the hollow space 11 of the tubular sleeve and through the tubular sleeve 3 and to the opposite side of the frame.

In the fastened position shown in FIG. 1 of the strings 5 the protruding wall parts 12 of the body 2, which delimit the peripheral groove 4, are deformed so far towards each other, that the edges 13 facing each other lie close to each other. In this way in aerodynamically advantageous closed external contour is formed, which protects the strings from damage at the same time. For simplifying the running through of the strings during mounting there are openings 14 provided in alignment with the tubular sleeves 3, which openings are delimited by recesses 15 at both sides of the openings 14 at the edges 13 of the protruding wall parts 12 facing each other.

Figure 2:
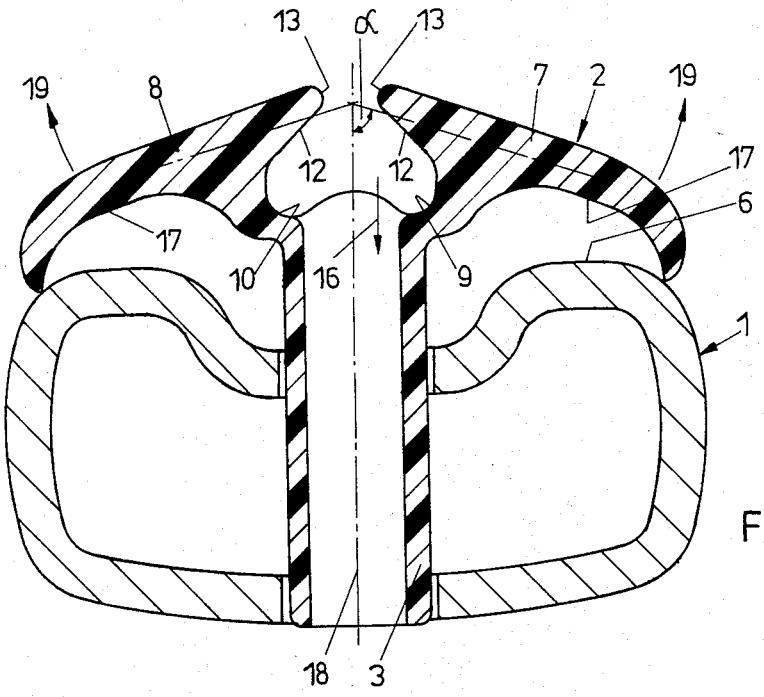
Figure 3:
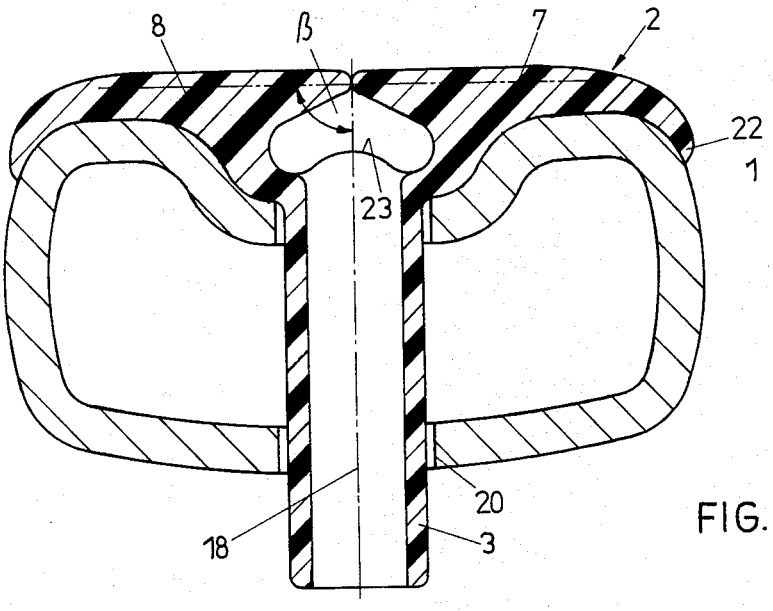

In FIG. 2 the body is shown in unfastened state, in which it is still on the frame 1. The body 2 is formed in one piece with the tubular sleeves and consists of elasticly deformable material, like synthetic material. By tensioning the strings the body is pressed in the direction of arrow 16, as is shown in FIG. 3, wherein the internal contour 17 of the lateral parts 7 and 8 fits closely with the external contour 6 of the frame 1. At the same time a movement of the edges 13 of the protruding wall parts 12 towards each other is caused, which in turn causes the angle $\alpha$ between the lateral parts 7 and 8 and the axis 18 of the tubular sleeves 3 before tensioning and shifting in direction of arrow 16, respectively, to be smaller than the angle $\beta$, which is taken by the lateral parts 7 and 8 with the axis 18 after tensioning, as it is shown in FIG. 3. The lateral parts 7 and 8 are thus folded in the direction of arrows 19 during a movement of the tubular sleeves in direction of arrow 16, from which results the closed embodiment shown in FIG. 3. The tubular sleeves 3 are arranged in intervals on the body 2, which correspond to the bores 20 in the frame of the tennis racket and penetrate the bores 20 during the movement of the body in the direction of arrow 16.

Figure 4:
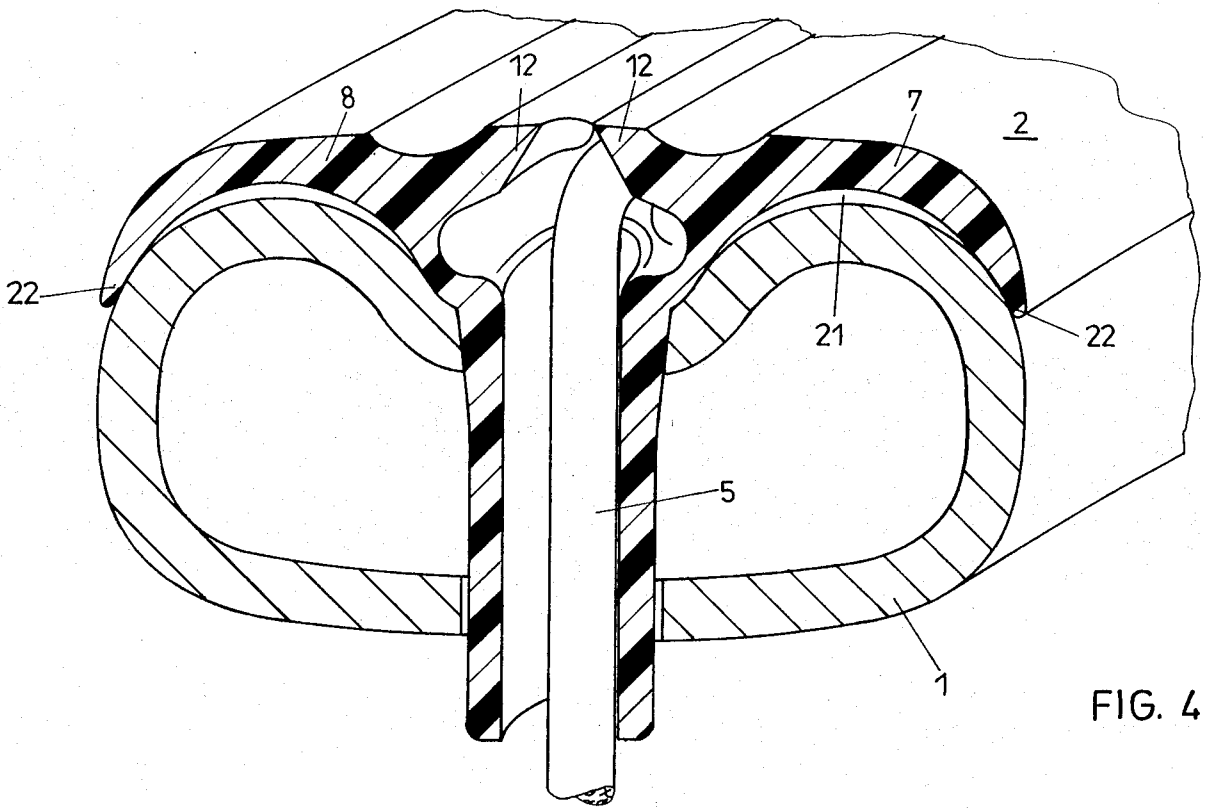
FIG. 4 shows a somewhat modified embodiment in a section similar to FIG. 1, FIG. 5 makes clear the mounting of the strings.

In the representation of FIG. 4 the body 2 being slightly modified in its profile is put onto the frame 1 and the strings 5 are tensioned. By the strings the body 2 is pressed onto the frame 1 in the direction of arrow 16 of FIG. 2. Between the frame 1 and the body 2 only a slight air gap is visible. It is only essential that the outer edges 22 fit closely with the frame 1, through which the aerodynamically advantageous form is obtained. Such an air gap has even favorable effects, because the elastic deformation of the lateral parts 7 and 8 and of the protruding wall parts 12 is hereby aided.

Figure 5:
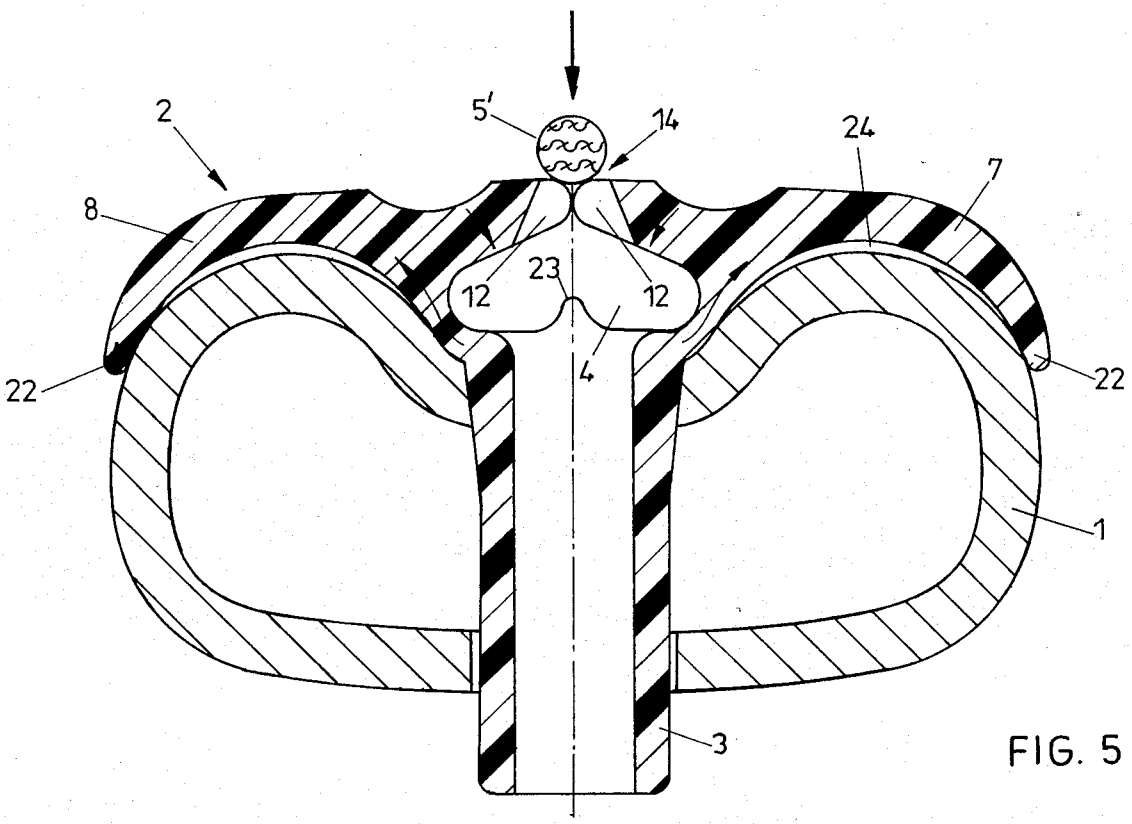

FIG. 5 illustrates the mounting of the strings. The body 2 lies in its position being pressed onto the frame, in which position it is held by the strings already tensioned. The string 5 to be mounted is layed in its position 5' onto the edges 13 of the protruding wall parts 12. The string is run through the opening 14 into the tubular sleeve 3. By tensioning the string 5 it presses the protruding wall parts 12 downwards and the string 5 slides from its position 5' between the downwards pressed protruding wall parts into the peripheral groove 4 of the body 2, whereafter the protruding wall parts 12 spring back to their shown position.

At several positions, where both a longitudinal and a transverse stringing is effected, two strings must be put into the peripheral groove which must be both run through the same tubular sleeve. Between the grooves 9 and 10 there is arranged a bulging 23, which is clearly visible in FIGS. 3 and 5. The string being first put into the peripheral groove is directed by the bulging 23 into one of the two grooves 9 or 10. The second string is equally directed by the bulging 23 into one of the grooves 9 or 10, in which there is not yet any string. Therefore, the strings will not lie on top of each other and since the position of the strings in the peripheral groove is precisely defined the necessary tension of the strings can be precisely observed.

It is essential that the edges 22 of the lateral parts 7 and 8 fit tightly with the frame of the tennis racket. According to FIG. 1 the lateral parts 7 and 8 fit closely with the frame 1. There may also remain an air gap 24 between the lateral parts 7 and 8 and the frame 1 as is shown in FIG. 5.

What is claimed is:

1. A device for protecting the strings of a racket used in playing games such as ball games, wherein the racket includes a frame (1) having an exterior surface with a peripheral groove therein and a plurality of spaced holes extending through the groove and opening both to the exterior of the frame and the interior of the frame, the spaced holes and groove receiving the strings (5) which are strung inside of the frame (1) to form the net of the racket, the device comprising:

a resilient bandlike body (2) positionable around the exterior surface of the frame, the resilient bandlike body being deflectable from a first position (FIG. 1) to a second position (FIG. 3);

an annular band groove (4) in the bandlike body (2), the annular band groove (4) opening externally with respect to the device and having a plurality of spaced band holes therein and adapted to be aligned with the spaced frame holes in the frame;

a pair of opposed shoulders (12) on the bandlike body with edges (13) projecting over the band groove (4) and defining a space therebetween when the resilient bandlike body (2) is in the first position (FIG. 1), the shoulders (12) closing over the groove (4) until the opposed ends abut when the bandlike body (2) is in the second position (FIG. 3), whereby, when the strings (5) are tightened, the resilient bandlike body (1) moves from the first position (FIG. 1) to the second position (FIG. 3) and the shoulders (12) close over the strings with the edges (13) of the shoulders (12) in abutment.

2. A device as claimed in claim 1, wherein the body (2) consists of elastically deformable material, particularly synthetic material, and has a first side adapted to face toward the frame and a second side adapted to face away from the frame.

3. A device as claimed in claim 2, wherein the side of the body (2) adapted to face toward the frame is adapted to keep free a space between the bottom of the peripheral groove of the frame (1) and the body (2) when in the first position during the untensioned state of the strings (5), into which space the body (2) is deformable by tightening the strings (5).

4. A device as claimed in claim 1, wherein the shoulders (12) of the body (2) are connected with lateral parts (7,8) of the body (2) that are adapted to overlap the frame (1).

5. A device as claimed in claim 4, wherein the device incudes tubular sleeves extending therefrom and associated with said spaced body holes and wherein edges (13) facing each other on the protruding wall parts (12) sit close to one to another after mounting the strings (5) and include recesses or openings (14, 15) being in alignment with the tubular sleeves (3).

6. A device as claimed in claim 4, wherein before mounting the strings (5) the lateral parts (7,8) of the body (2) adapted to overlap the frame (1) are inclined to the axis of the tubular sleeves (3).

7. A device as claimed in claim 6, wherein in a cross-sectional profile the lateral parts (7, 8) of the body (2) are formed so as to be adaptable to the external contour (6) of the frame (1).

8. A device as claimed in claim 6, wherein the lateral parts of the body include lateral edges and wherein at least the lateral edges of the body are adapted to fit closely with the frame when the strings are mounted.

9. A device as claimed in claim 8, wherein the bottom of the band groove (4) of the body (2) that is adjacent to the tubular sleeves (3) comprises, in a cross-sectional profile, grooves (9, 10) of rounded cross-section that are located adjacent to the shoulders (12) and extend in a longitudinal direction.

10. A device as claimed in claim 9, wherein the cross-section of the grooves (9, 10) adapted to be at least as large as the cross-section of the strings (5) and between the grooves (9, 10) a bulge (23) extending in a longitudinal direction and being arranged opposite the shoulders (12) is provided

* * * * *